US009223286B2

(12) United States Patent
Fukao

(10) Patent No.: US 9,223,286 B2
(45) Date of Patent: Dec. 29, 2015

(54) IMAGE FORMING APPARATUS

(75) Inventor: Moriaki Fukao, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 221 days.

(21) Appl. No.: 13/615,051

(22) Filed: Sep. 13, 2012

(65) Prior Publication Data

US 2013/0071139 A1 Mar. 21, 2013

(30) Foreign Application Priority Data

Sep. 15, 2011 (JP) ..... 2011-201247

(51) Int. Cl.
*G03G 21/16* (2006.01)
*G03G 21/18* (2006.01)

(52) U.S. Cl.
CPC ..... *G03G 21/1633* (2013.01); *G03G 21/16* (2013.01); *G03G 21/1853* (2013.01); *G03G 2215/0119* (2013.01); *G03G 2221/163* (2013.01); *G03G 2221/169* (2013.01); *G03G 2221/1654* (2013.01); *G03G 2221/1684* (2013.01)

(58) Field of Classification Search
CPC ..... G03G 21/16
USPC ..... 399/110, 111
See application file for complete search history.

(56) References Cited

U.S. PATENT DOCUMENTS 5,978,626 A * 11/1999 Nagamine et al. ..... 399/125
2007/0065174 A1* 3/2007 Rennick et al. ..... 399/110
2007/0077085 A1* 4/2007 Kitamura et al. ..... 399/110
2007/0147882 A1* 6/2007 Igarashi ..... 399/110
2009/0214235 A1* 8/2009 Hattori ..... 399/37
2013/0071139 A1* 3/2013 Fukao ..... 399/110
2013/0259521 A1* 10/2013 Sugiyama ..... 399/110
2014/0044450 A1* 2/2014 Nakamura ..... 399/110
2014/0056612 A1* 2/2014 Mori ..... 399/110

FOREIGN PATENT DOCUMENTS

JP 2003-186340 7/2003
JP 2005-186332 * 7/2005
JP 2007065125 A 3/2007
JP 2008-304810 12/2008
JP 2009-204838 9/2009
JP 2011-141532 7/2011

* cited by examiner

*Primary Examiner* — Clayton E Laballe
*Assistant Examiner* — Kevin Butler
(74) *Attorney, Agent, or Firm* — Rabin & Berdo, P.C.

(57) ABSTRACT

An image forming apparatus includes: a plurality of developing units disposed in parallel with each other, a developer cartridge being detachably attached to each of the plurality of developing units, each of the plurality of developing units forming a developer image with a developer agent in the developer cartridge; a first cover covering at least one specified developer cartridge of a plurality of developer cartridges attached to the plurality of developing units, the first cover being openable to allow the at least one specified developer cartridge to be attached and detached; and a second cover covering at least one developer cartridge other than the at least one specified developer cartridge of the plurality of developer cartridges, the second cover being openable to allow the at least one developer cartridge other than the at least one specified developer cartridge to be attached and detached.

13 Claims, 7 Drawing Sheets

IMAGE FORMING APPARATUS

BACKGROUND OF THE INVENTION

1. Field of the Invention

The present invention relates to an image forming apparatus.

2. Description of the Related Art

There is an image forming apparatus having a plurality of developing devices and forming images by using electrophotographic techniques. See, for example, Japanese Patent Application Publication No. 2007-65125.

Further, there is an image forming apparatus including a plurality of developing units to which developer cartridges are detachably attached respectively, an openable upper cover covering the plurality of developing units, and a plurality of exposure heads attached to the upper cover, the respective exposure heads engaging with the respective developing units by closing of the upper cover. In the image forming apparatus, replacement of each of the developer cartridges is performed by opening the upper cover.

In a configuration having a cover for covering all of a plurality of developer cartridges, the cover has a large size, and opening/closing movement of the cover during replacement of the developer cartridge is large. Thus, for example, the workload at the time of replacing the developer cartridge is heavy.

SUMMARY OF THE INVENTION

An object of the present invention is to provide an image forming apparatus capable of reducing opening/closing movement of a cover during replacement of a developer cartridge.

According to an aspect of the present invention, there is provided an image forming apparatus including: a plurality of developing units disposed in parallel with each other, a developer cartridge being detachably attached to each of the plurality of developing units, each of the plurality of developing units forming a developer image with a developer agent in the developer cartridge; a first cover covering at least one specified developer cartridge of a plurality of developer cartridges attached to the plurality of developing units, the first cover being openable to allow the at least one specified developer cartridge to be attached and detached; and a second cover covering at least one developer cartridge other than the at least one specified developer cartridge of the plurality of developer cartridges, the second cover being openable to allow the at least one developer cartridge other than the at least one specified developer cartridge to be attached and detached.

According to this aspect of the present invention, it becomes possible to reduce opening/closing movement of a cover during replacement of a developer cartridge.

DETAILED DESCRIPTION OF THE INVENTION

Figure 1:
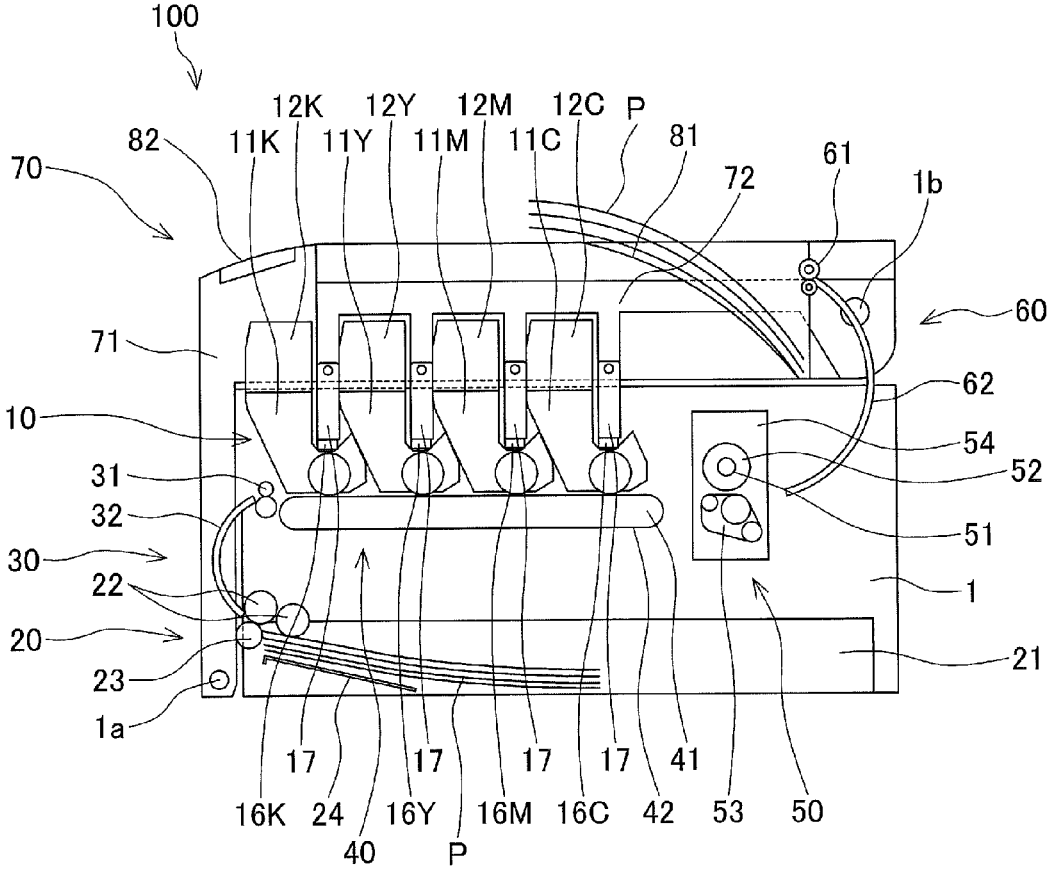
FIG. 1 is a schematic diagram illustrating a configuration of an image forming apparatus according to a first embodiment.

Embodiments of the present invention will be explained below in detail, referring to the drawings.

First Embodiment (Configuration of Image Forming Apparatus)

Figure 2:
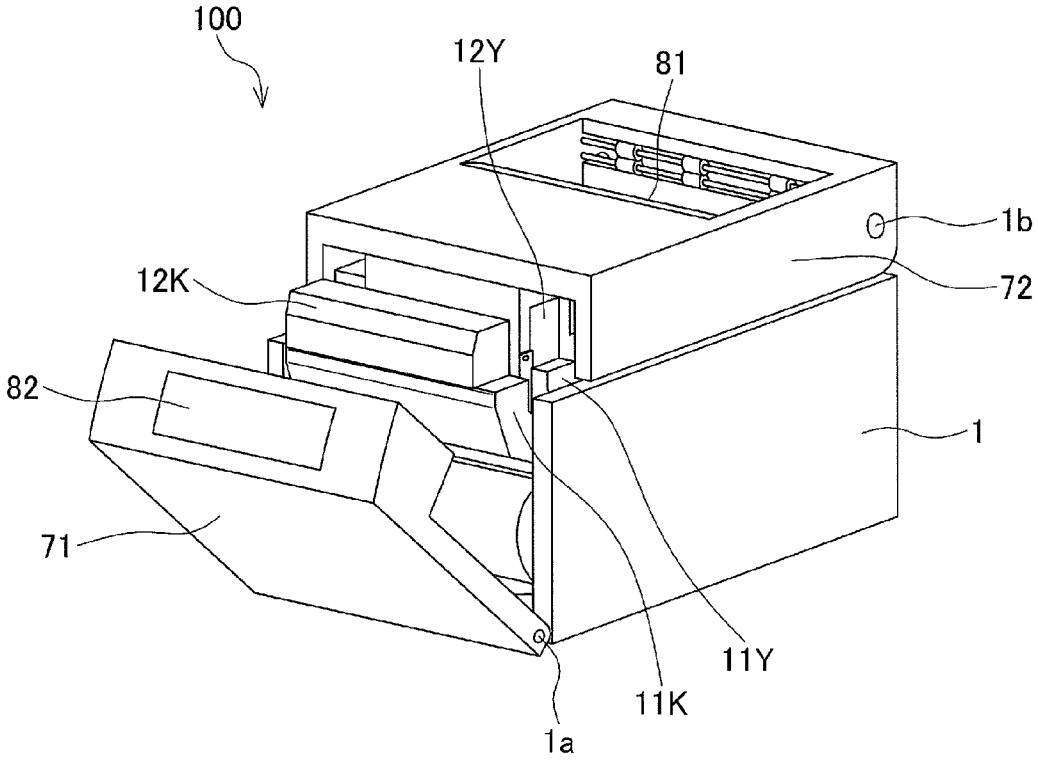
FIG. 2 is a perspective view illustrating the configuration of the image forming apparatus according to the first embodiment.

FIGS. 1 and 2 are respectively a schematic diagram and a perspective view illustrating a configuration of an image forming apparatus 100 in a first embodiment. The image forming apparatus 100 forms an image using a plurality of developing units by an electrophotographic method.

Referring to FIG. 1, the image forming apparatus 100 includes a main body of the image forming apparatus (hereinafter referred to as 'main body') 1, an image forming unit 10, a medium feeding unit 20, a medium conveying unit 30, an image transferring unit 40, an image fixing unit 50, a medium discharging unit 60, and an external cover unit 70.

The image forming unit 10 forms a developer image, and is disposed in the center of the main body 1 in the example of FIG. 1. Specifically, the image forming unit 10 has the plurality (four in this example) of developing units 11K, 11Y, 11M, and 11C. These developing units 11K, 11Y, 11M, and 11C form images in colors of black (K), yellow (Y), magenta (M), and cyan (C) respectively.

To the developing units 11K, 11Y, 11M, and 11C, developer cartridges 12K, 12Y, 12M, and 12C are detachably attached respectively. The developer cartridges 12K, 12Y, 12M, and 12C contain developer agents in the colors K, Y, M, and C respectively. Each of the developing units 11K, 11Y, 11M, and 11C forms a developer image by using the developer agent in the corresponding developer cartridge attached to the developing unit. Specifically, the developer cartridges 12K, 12Y, 12M, and 12C can be independently attached to and detached from the developing units 11K, 11Y, 11M, and 11C respectively, and each developer cartridge can be replaced when the developer agent is used up in the corresponding developing unit.

The developing units 11K, 11Y, 11M, and 11C are disposed in parallel with each other inside the main body 1. Specifically, the developing units 11K, 11Y, 11M, and 11C are disposed so that images are formed on a fed paper sheet P as a recording medium in an order of K, Y, M, and C. The developing units 11K, 11Y, 11M, and 11C have the same configuration, and will be collectively referred to as 'developing unit 11' hereinafter. The developer cartridges 12K, 12Y, 12M, and 12C have the same configuration except for colors of the developer agents, and will be collectively referred to as 'developer cartridge 12' hereinafter.

Figure 3:
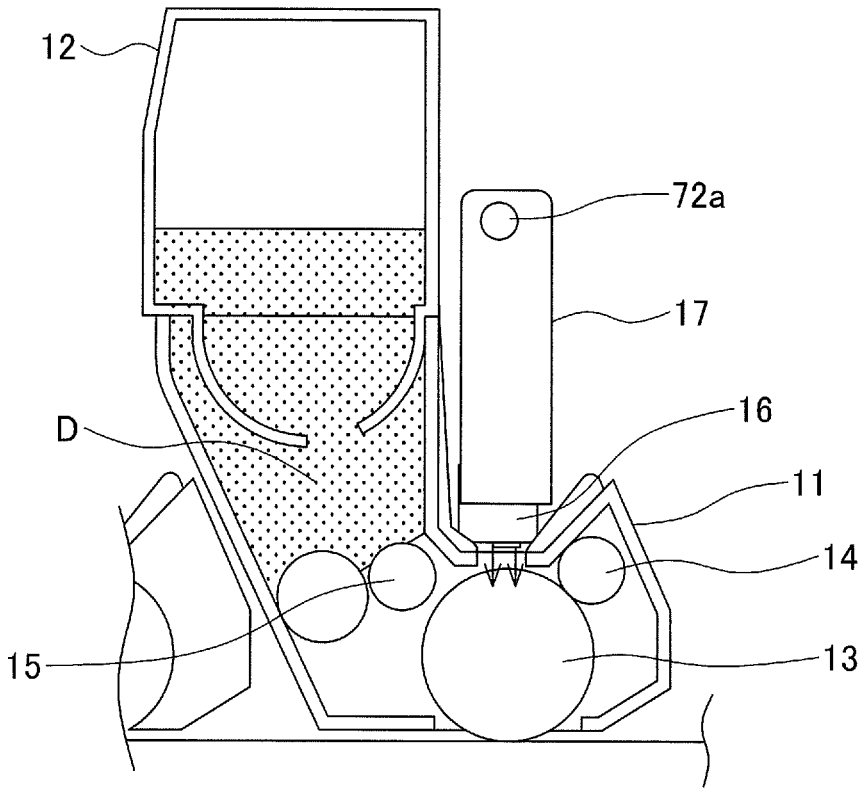
FIG. 3 is a schematic diagram illustrating configurations of a developing unit and a developer cartridge.

As illustrated in FIG. 3, in this example, the developing unit 11 has a photosensitive drum 13 as an image carrier, a charging unit 14 and a developer supplying unit 15. The charging unit 14 supplies electric charges to and thereby charges a surface of the photosensitive drum 13 which rotates in a predetermined direction, and is, for example, a charging roller. On the downstream side of the charging unit 14 in the rotation direction of the photosensitive drum 13, an exposure head 16 to be described later is disposed. The exposure head 16 illuminates the charged surface of the photosensitive drum 13 to form an electrostatic latent image, and is, for example, an LED head having an LED as a light emitting element. The developer supplying unit 15 develops the electrostatic latent image formed on the photosensitive drum 13 by using a developer agent D to form a developer image. The developing unit 11 may include a cleaning unit such as a cleaning blade for removing a residual developer agent on the surface of the photosensitive drum 13 after the transfer.

Referring to FIGS. 1 and 2 again, the medium feeding unit 20 feeds a paper sheet P for image formation, and is disposed in the lower part of the main body 1 in the example of FIG. 1. Specifically, the medium feeding unit 20 has a medium cassette 21 for accommodating the sheet P, a medium feed roller 22 and a medium separation roller 23 for picking up the sheet P from the medium cassette 21 and sending it to the medium conveying unit 30, and a medium feed hopping plate 24 for pressing the sheet P in the medium cassette 21 against the medium feed roller 22.

The medium conveying unit 30 conveys the sheet P fed from the medium feeding unit 20 to the image forming unit 10, and is disposed in a side part (or a front part) of the main body 1 in the example of FIG. 1. Specifically, the medium conveying unit 30 has a resist roller 31 and a medium guide 32. The resist roller 31 is disposed upstream from the developing unit 11K in a medium conveying direction and has a function to align the sheet P before the sheet P enters the image forming unit 10. The medium guide 32 is disposed between the medium feeding unit 20 and the resist roller 31 and has a function to guide the sheet P fed by the medium feed roller 22 to the resist roller 31.

The image transferring unit 40 transfers the developer images formed by the image forming unit 10 onto the sheet P from the medium conveying unit 30, and is disposed under the image forming unit 10 or the developing units 11 in the example of FIG. 1. Specifically, the image transferring unit 40 has a transfer belt unit 41. The transfer belt unit 41 conveys the sheet P from the resist roller 31 and transfers the developer images formed by the developing units 11K, 11Y, 11M, and 11C onto the sheet P successively. The transfer belt unit 41 includes, for example, an endless transfer belt 42 for supporting the sheet P from the resist roller 31 and conveying it along the developing units 11K, 11Y, 11M, and 11C; and four transfer rollers (not illustrated) for transferring the respective color developer images formed on the photosensitive drums 13 in the respective developing units 11 onto the sheet P on the transfer belt 42.

The image fixing unit 50 is disposed downstream from the image forming unit 10 and the image transferring unit 40 in the medium conveying direction, and fixes the developer images transferred by the image transferring unit 40 onto the sheet P. Specifically, the image fixing unit 50 has a fixing unit 54 configured by a heating element 51, a pressure roller 52, and a pressure belt 53.

The medium discharging unit 60 is disposed downstream from the image fixing unit 50 in the medium conveying direction, and conveys and discharges the sheet P with the developer images fixed thereon by the image fixing unit 50, i.e., the printed sheet P. Specifically, the medium discharging unit 60 has a discharge roller 61 for discharging the printed sheet P to a medium stacker 81 outside the apparatus, and a medium guide 62 for guiding the sheet P between the fixing unit 54 and the discharge roller 61.

The external cover unit 70 covers the main body 1. In this embodiment, the external cover unit 70 has a first cover 71 and a second cover 72. Specifically, the image forming apparatus 100 has the two covers 71 and 72 that openably cover an upper part of the image forming apparatus 100 (or the main body 1) so that the upper part is divided by the two covers.

The first cover 71 covers at least one specified developer cartridge 12 of the plurality of developer cartridges 12, and is openable to allow attaching and detaching of the specified developer cartridge 12. Specifically, the first cover 71 is openably and closably provided to the main body 1, and configured so as to cover the specified developer cartridge 12 in the closed state and so as to allow attaching and detaching of the specified developer cartridge 12 in the open state.

In this example, the at least one specified developer cartridge 12 is the black developer cartridge 12K, which is used most frequently. When the first cover 71 is opened as illustrated in FIG. 2, only the black developer cartridge 12K can be attached and detached.

Moreover, the first cover 71 is configured so as to cover an apparatus upper part and an apparatus side part (or an apparatus vertical plane part) in the closed state and so as to uncover the apparatus upper part and the apparatus side part in the open state. Here, the apparatus upper part and the apparatus side part are the upper part and a side part of the image forming apparatus 100 or the main body 1 respectively.

Furthermore, the first cover 71 is configured so as to cover the medium conveying unit 30 (or the medium guide 32) in the closed state and uncover the medium conveying unit 30 (or the medium guide 32) in the open state.

Specifically, the first cover 71 has an L-shaped cross section so as to cover the apparatus upper part and an apparatus front part. When the first cover 71 is opened toward the front side of the apparatus, the apparatus upper part and the apparatus front part are uncovered, and the developer cartridge 12K (or the developing unit 11K) and the medium conveying unit 30 are exposed. More specifically, the first cover 71 is rotatably attached to the main body 1 and is configured to be opened and closed by its rotation. In FIGS. 1 and 2, the first cover 71 is rotatably supported around a rotation shaft 1*a* that is disposed at a lower end part of a front side of the main body 1 and extends in a left-right direction.

The second cover 72 covers at least one developer cartridge 12 other than the at least one specified developer cartridge 12 of the plurality of developer cartridges 12 (hereinafter referred to as 'other at least one developer cartridge'), and is openable to allow attaching and detaching of the other at least one developer cartridge 12. Specifically, the second cover 72 is openably and closably provided to the main body 1, and is configured so as to cover the other at least one developer cartridge 12 in the closed state and so as to allow attaching and detaching of the other at least one developer cartridge 12 in the open state.

In one aspect, the second cover 72 covers more than one developer cartridges 12 other than the at least one specified developer cartridge 12 of the plurality of developer cartridges 12. In this example, the Y, M, and C-color developer cartridges 12Y, 12M, and 12C are the other at least one developer cartridge. When the second cover 72 is opened, the developer cartridges 12Y, 12M, and 12C can be attached and detached. Moreover, in this example, the image forming apparatus 100 is configured so that the other developer cartridges 12Y, 12M, and 12C can be attached and detached by opening the first cover 71 and then opening the second cover 72.

Moreover, the second cover 72 is configured so as to cover the apparatus upper part in the closed state and uncover the apparatus upper part in the open state.

Specifically, when the second cover 72 is opened toward the upper side of the apparatus, the apparatus upper part is uncovered, and the developer cartridges 12Y, 12M, and 12C (or the developing units 11Y, 11M, and 11C) are exposed. More specifically, the second cover 72 is rotatably attached to the main body 1 and is configured to be opened and closed by its rotation. In FIGS. 1 and 2, the second cover 72 is rotatably supported around a rotation shaft 1*b* that is disposed at an upper end part of a back side of the main body 1 and extends in the left-right direction.

Moreover, the second cover 72 has a holding unit for holding the respective developing units 11 in the closed state of the second cover 72 and releasing the respective developing units 11 in the open state of the second cover 72. Specifically, the second cover 72 holds a latent image forming unit (e.g., a print head) for forming latent images to be developed by the respective developing units 11. The latent image forming unit engages with the respective developing units 11 in the closed state of the second cover 72, and separates from the respective developing units 11 in the open state of the second cover 72, and thus functions as the holding unit. More specifically, the second cover 72 holds, as the latent image forming unit, four exposure heads 16K, 16Y, 16M, and 16C corresponding one-to-one to the four developing units 11K, 11Y, 11M, and 11C through respective head holders 17. Each of the head holders 17 is held by the second cover 72 at a rotation pivot 72*a* and can be rotated within a limited range relative to the second cover 72. The exposure heads 16K, 16Y, 16M, and 16C have the same configuration and will be collectively referred to as 'exposure head 16' hereinafter.

Figure 4:
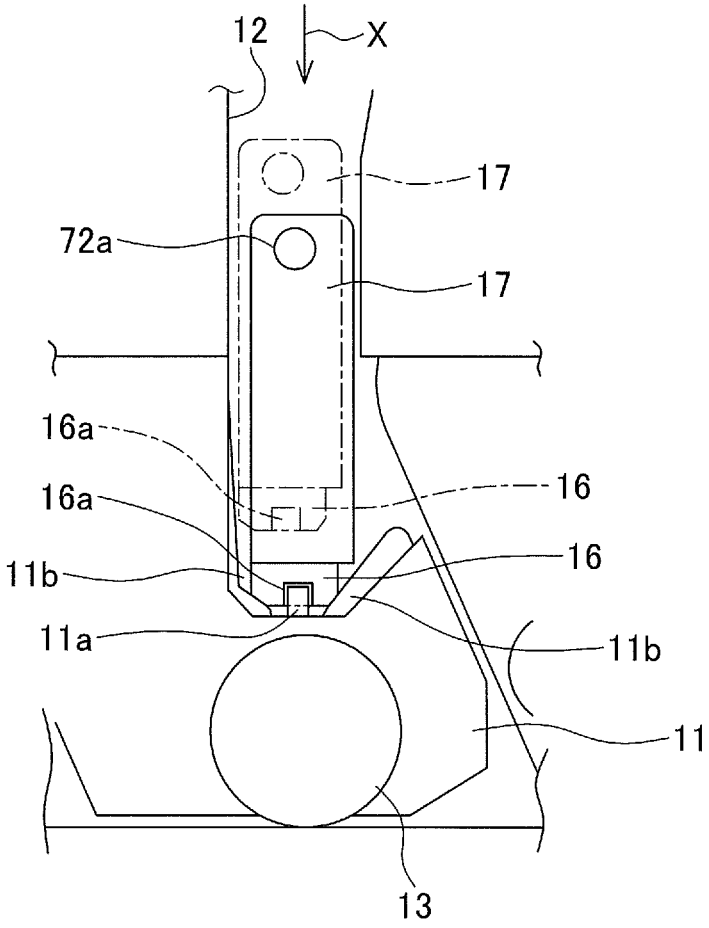
FIG. 4 is a schematic diagram illustrating a configuration of engagement between the developing unit and an exposure head.

As illustrated in FIG. 4, the developing unit 11 has an engagement portion 11*a* and the exposure head 16 corresponding to the developing unit 11 has an engagement portion 16*a*. In the state where the second cover 72 is closed, the exposure head 16 is precisely positioned relative to the developing unit 11 due to engagement between the engagement portion 11*a* and the engagement portion 16*a*. In this example, the engagement portion 11*a* is a positioning pin, the engagement portion 16*a* is a positioning hole, and the positioning is performed by fitting the positioning pin 11*a* into the positioning hole 16*a*.

The developing unit 11, the developer cartridge 12, the exposure head 16, and the head holder 17 are configured so that, when the second cover 72 is closed, the exposure head 16 moves while being guided by the developer cartridge 12 and the developing unit 11 to engage with the developing unit 11. Specifically, when the second cover 72 is closed from the open state, the exposure head 16 and the head holder 17 holding the exposure head 16 move in a head inserting direction (in an X arrow direction in FIG. 4) and enter a gap between the developer cartridges 12. At this time, the exposure head 16 moves in contact with the developing cartridge 12, the head holder 17 slightly freely rotates, and the exposure head 16 proceeds while being guided by an outer surface of the developer cartridge 12. When the second cover 72 is further closed, the exposure head 16 is guided by a head guide 11*b* provided on the developing unit 11 to a predetermined fitting position. When the exposure head 16 and the developing unit 11 are fit together, the positioning pin 11*a* projecting from the developing unit 11 enters the positioning hole 16*a* in the exposure head 16, and the exposure head 16 is precisely positioned relative to the developing unit 11. Specifically, the exposure head 16 is positioned in a position where the exposure head 16 can appropriately expose the photosensitive drum 13 in the corresponding developing unit 11 and a position where a relative positional relationship among the four exposure heads 16 is ensured.

Furthermore, the exposure head 16 is held by the head holder 17 through a spring (not illustrated) as a bias member. In the state where the second cover 72 is closed and the exposure head 16 is engaged and positioned relative to the developing unit 11, the exposure head 16 presses the developing unit 11 with the spring (the bias member). Therefore, the developing unit 11 is secured in the main body 1 and the exposure head 16 is also secured by the spring, so that the positioning is established.

Thus, the respective exposure heads 16 and the respective developing units 11 are precisely positioned, and this allows proper image formation by the respective exposure heads 16 and the respective developing units 11.

Referring to FIGS. 1 and 2 again, the external cover unit 70 includes the medium stacker 81 as a medium discharge portion on which the sheet P after the image formation is discharged and placed, and an information display unit 82 for displaying information to an user (information on instructions from the apparatus to the user, for example). In this example, the medium stacker 81 is formed on the second cover 72, and the information display unit 82 is attached to the first cover 71.

(Operation of the Image Forming Apparatus)

Next, operation of the image forming apparatus 100 will be explained. When the image forming apparatus 100 starts printing, in each of the developing units 11K, 11Y, 11M, and 11C in the image forming unit 10, the photosensitive drum 13 rotates and the surface of the photosensitive drum 13 is charged by the charging unit 14. Then, the exposure head 16 emits neutralization light from a position corresponding to an image to be formed, to the charged surface of the photosensitive drum 13. The developer agent D from the developer supplying unit 15 adheres onto the illuminated portion of the surface of the photosensitive drum 13, so that the image is formed on the surface of the photosensitive drum 13.

Meanwhile, in the medium feeding unit 20, the medium feed hopping plate 24 is raised, and the sheets P in the medium cassette 21 are pressed against the medium feed roller 22. Then, due to the rotation of the medium feed roller 22 and the function of the medium separation roller 23, one of the sheets P is conveyed to the resist roller 31 while guided by the medium guide 32. After the sheet P is aligned by the resist roller 31, the sheet P is conveyed by the transfer belt unit 41 and passes through the developing units 11K, 11Y, 11M, and 11C in this order. At this time, the images of the four colors K, Y, M, and C formed with the developer agents D by the developing units 11 for respective colors are sequentially transferred onto the sheet P. The sheet P on which the image has been formed is conveyed to the image fixing unit 50 by the transfer belt unit 41.

In the image fixing unit 50, the fixing unit 54 fixes the developer agents D onto the sheet P by applying heat and pressure through the heated pressure roller 52 and the pressure belt 53.

The sheet P with the image fixed thereon is guided by the medium guide 62 to the discharge roller 61 and discharged by the discharge roller 61 to the medium stacker 81 formed on an upper surface of the second cover 72.

Figure 5:
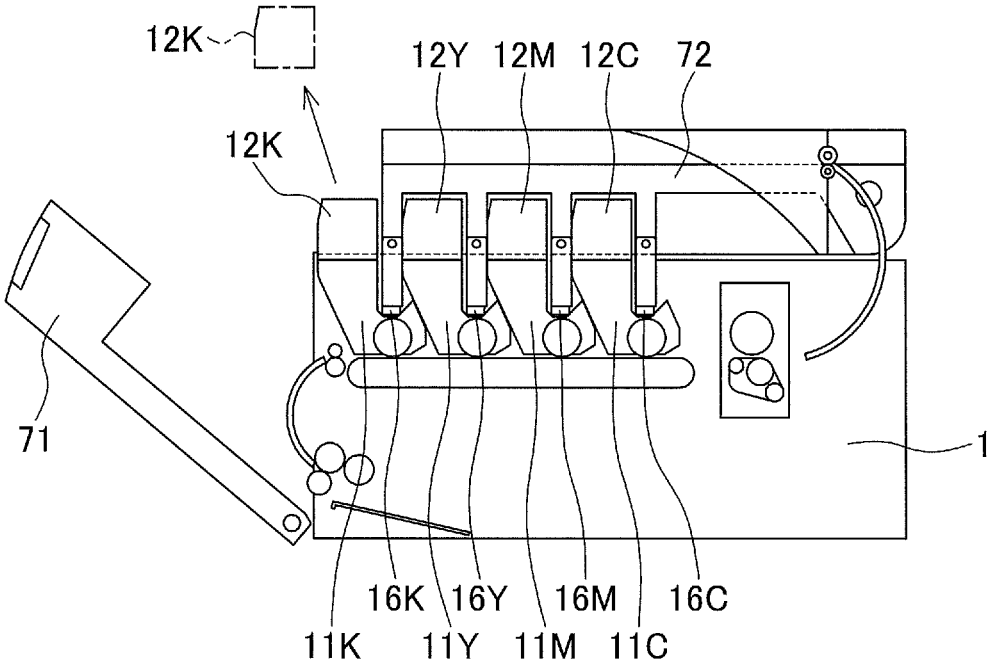
FIG. 5 is a schematic diagram illustrating the image forming apparatus with a first cover opened.

As the printing is repeated, the developer agent D inside the developer cartridge 12 is gradually consumed. If the developer agent D inside the black developer cartridge 12K has been consumed and the developer cartridge 12K needs to be replaced, the image forming apparatus 100 displays a message for urging a user to replace the black developer cartridge 12K on the information display unit 82, and temporarily stops operation of the apparatus. In this case, the user opens the first cover 71 as illustrated in FIG. 5. With this operation, only the black developer cartridge 12K is uncovered. Next, the user replaces the black developer cartridge 12K and closes the first cover 71. Here, the first cover 71 has a smaller size than a conventional cover covering all of four developing units, and the first cover 71 can be easily opened and closed in comparison with the conventional cover.

Figure 6:
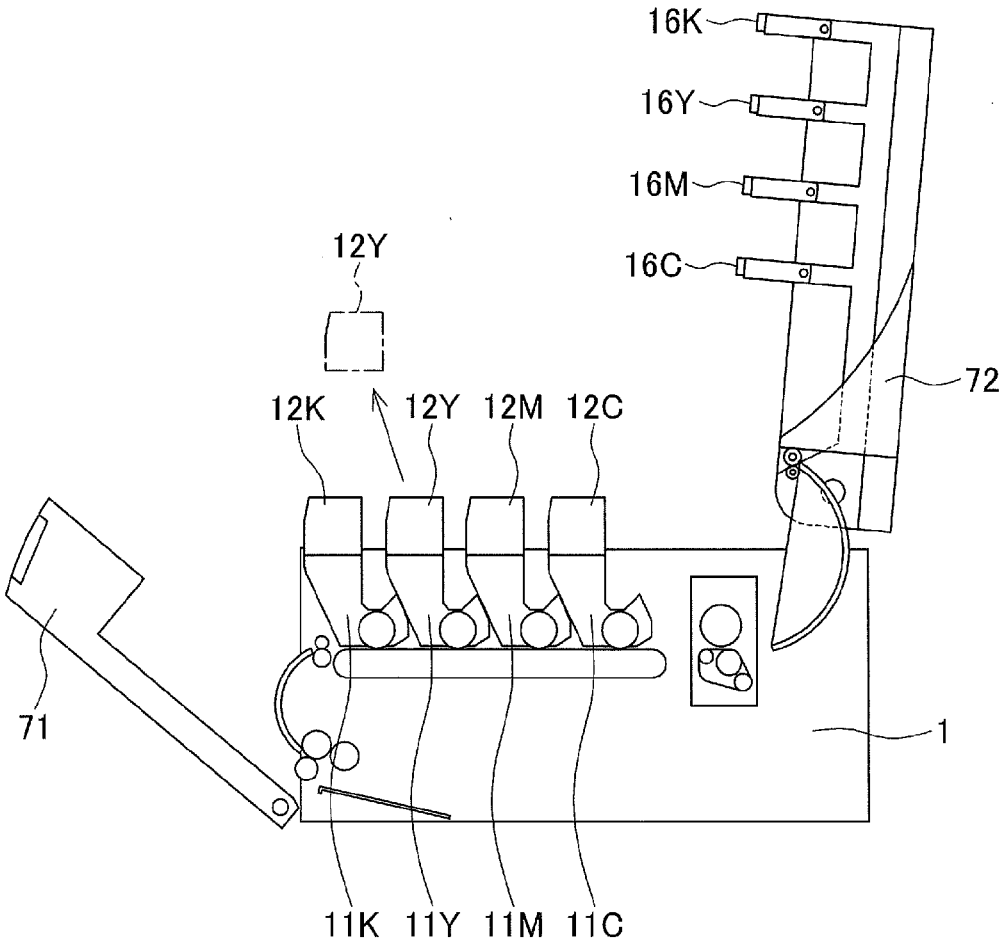
FIG. 6 is a schematic diagram illustrating the image forming apparatus with a second cover opened.

If the Y, M, or C-color developer cartridge 12Y, 12M, or 12C need to be replaced, the user opens the first cover 71 as illustrated in FIG. 5, then opens the second cover 72 as illustrated in FIG. 6, and replaces the target developer cartridge 12. After the replacement, the user closes the second cover 72 and then closes the first cover 71. Here, the second cover 72 has a smaller size than the conventional cover covering all of the four developing units, and the second cover 72 can be easily opened and closed in comparison with the conventional cover.

If a sheet jam occurs in the medium conveying unit 30, e.g., if the sheet P is jammed between the medium feed roller 22 and the resist roller 31, the user opens the first cover 71 to uncover the medium conveying unit 30 (or the medium guide 32) and removes the jammed sheet P. In other words, in this example, the first cover 71 is used as a cover to be opened when a sheet jam is removed, as well as a cover to be opened when the black developer cartridge 12K is replaced.

(Advantageous Effects)

According to the first embodiment as described above, the following advantageous effects (1) to (6) can be obtained.

(1) According to the present embodiment, the image forming apparatus includes the first cover covering the at least one specified developer cartridge of the plurality of developer cartridges and openable to allow the at least one specified developer cartridge to be attached and detached, and the second cover covering the other at least one developer cartridge and openable to allow the other at least one developer cartridge to be attached and detached. According to this embodiment, in comparison with a configuration including a cover covering all of a plurality of developer cartridges, the size of each of the covers can be reduced, and therefore opening/closing movement of the cover (each of the covers) during replacement of the developer cartridge can be reduced. Accordingly, for example, it is possible to facilitate a cover opening/closing operation during replacing the developer cartridge, and reduce the workload at the time of replacing the developer cartridge.

Specifically, in the case of the conventional image forming apparatus including the cover covering all of the four developer cartridges, a user needs to widely open the cover when replacing the developer cartridge. A rotation angle of the cover during the opening operation is, for example, from 70 degrees to 100 degrees, and opening/closing movement of the cover is large. For this reason, a user, especially a small user, has a heavy workload when opening/closing the cover to replace the developer cartridge, and it is desired to reduce the workload. According to this embodiment, in comparison with the above configuration, the size of the cover (each of the first and second covers) can be reduced and the workload of the cover opening/closing operation can be reduced.

(2) According to one aspect, the at least one specified developer cartridge is a black developer cartridge. According to this aspect, it is facilitated to replace the black developer cartridge, which is frequently replaced, and usability can be improved.

(3) According to another aspect, the second cover has the holding unit for holding each of the plurality of developing units in the closed state of the second cover. According to this aspect, while the state where each of the developing units is held by the second cover is maintained, the at least one specified developer cartridge can be replaced by opening only the first cover. Therefore, in comparison with the configuration where releasing and holding of the developing units are performed each time any of the developer cartridges is replaced, the number of times (or frequency) of releasing and holding of the developing units accompanying replacement of the developer cartridge can be reduced, and wear of a member relating to the holding can be reduced.

(4) According to another aspect, the holding unit is a latent image forming unit held by the second cover, and the latent image forming unit engages with each of the plurality of developing units and forms a latent image to be developed by each of the plurality of developing units in the closed state of the second cover. According to this aspect, while the engagement between the developing units and the latent image forming unit is maintained, the specified developer cartridge can be replaced by opening only the first cover. Therefore, in comparison with the configuration where disengagement and engagement are performed each time any of the developer cartridges is replaced, the number of times (or frequency) of disengagement (or separation) and engagement between the developing units and the latent image forming unit accompanying replacement of the developer cartridge can be reduced, and wear of a member relating to the engagement can be reduced.

Specifically, in an image forming apparatus including four developing units to which four developer cartridges are detachably attached, a cover covering all of the four developer cartridges, and four exposure heads held by the cover and engaging with the four developing units in the closed state of the cover, each time any of the developer cartridges is replaced, the cover is opened and closed, and the exposure heads separate from the developing units and then engage with them again. If the above operation is frequently repeated, a member relating to the engagement wears. As a result, the positions of the exposure heads are displaced relative to photosensitive drums in the developing units, and it may cause a defect in a formed image. For this reason, it is desirable that the number of times (or frequency) of separation and re-engagement between the developing units and the exposure heads is low. In the image forming apparatus described above, separation and re-engagement between the developing units and the exposure heads are performed each time any of the developer cartridges is replaced, and the number of times (or frequency) of the separation and the re-engagement is high. By contrast, in the present embodiment, when the black developer cartridge 12K is replaced, because it is enough to open only the first cover 71 and it is not necessary to open the second cover 72, the engagement (or positioning) state between the developing units 11 and the exposure heads 16 can be maintained. As a result, the number of times (or frequency) of the separation and re-engagement between the developing units 11 and the exposure heads 16 can be reduced. Therefore, reliability of the apparatus can be improved, wear of the head guide 11*b*, the positioning pin 11*a*, and the positioning hole 16*a* can be reduced, and the displacement of the exposure head 16 can be suppressed.

(5) According to another aspect, the first cover uncovers the medium conveying unit for conveying a recording medium for image formation in the open state. According to this aspect, a recording medium jam in the medium conveying unit can be removed by opening the first cover. Moreover, while the state where the developing units are held by the second cover is maintained, jam removal can be performed by opening only the first cover. Thus, the number of times (or frequency) of releasing and holding of the developing units accompanying jam removal can be reduced, and wear of a member relating to the holding can be reduced.

(6) According to another aspect, the second cover has the medium discharge portion on which a recording medium after image formation is discharged. According to this aspect, if a recording medium after image formation is placed on the medium discharge portion of the second cover, replacement of the specified developer cartridge or removing of a medium jam in the medium conveying unit can be performed, without changing the state of the recording medium on the medium discharge portion.

Second Embodiment

Figure 7:
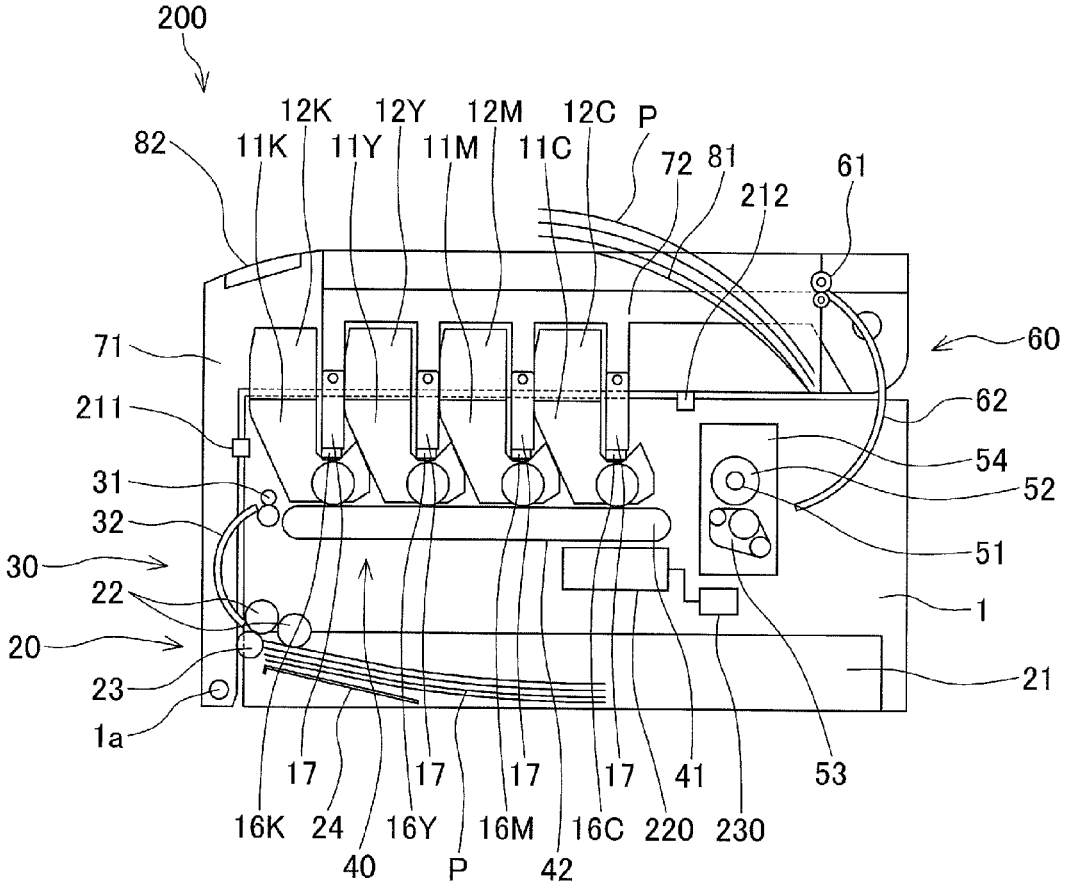
FIG. 7 is a schematic diagram illustrating a configuration of an image forming apparatus according to a second embodiment.

FIG. 7 is a schematic diagram illustrating a configuration of an image forming apparatus 200 according to a second embodiment. As the image forming apparatus 200 is substantially the same as the image forming apparatus 100 in the first embodiment, the same elements as those in the first embodiment will be denoted by the same reference characters as those in the first embodiment, and their description will be omitted or simplified.

In FIG. 7, when the second cover 72 is opened and then closed again, the developing units 11 and the exposure heads 16 separate from each other and then engage together again. In this case, between before the opening of the cover and after the closing of the cover, the position of each of the developing units 11 and the position of each of the exposure heads 16 slightly change. As a result, the positions of the images formed by the respective developing units 11 (for example, positions of images of respective colors on a sheet P) changes.

In the second embodiment, the image forming apparatus 200 includes a control unit 230 that corrects a position error of an image formed by each of the developing units 11 when the control unit 230 detects that the second cover 72 is closed. The control unit 230 performs a color registration error correction for correcting a position error between images formed by the respective developing units 11 (position error between images of the respective colors on the sheet P, for example) or a printing position error correction for correcting a position error of the image formed by each of the developing units 11 relative to the sheet P. Specifically, when the control unit 230 detects that the second cover 72 is closed, the control unit 230 forms a pattern for correction on a transfer medium (the transfer belt 42 or the sheet P, for example) by each of the developing units 11, reads the formed patterns, and corrects a position error of the image formed by each of the developing units 11 based on the result of the reading.

In the example illustrated in FIG. 7, the image forming apparatus 200 further includes a first cover sensor switch 211, a second cover sensor switch 212, and a sensor unit 220.

The first cover sensor switch 211 is a sensor for detecting an open/closed state of the first cover 71, and is attached to the first cover 71, for example. The second cover sensor switch 212 is a sensor for detecting an open/closed state of the second cover 72, and is attached to the second cover 72, for example.

The sensor unit 220 is a sensor for reading a check pattern for correction formed on the transfer medium (the transfer belt 42 in this example), and is attached to the lower part of the transfer belt unit 41, for example.

When the control unit 230 detects, based on output from the second cover sensor switch 212, that the second cover 72 is closed, the control unit 230 forms the check pattern for correction on the transfer medium (the transfer belt 42 in this example) by each of the developing units 11, reads the formed check pattern by the sensor unit 220, and corrects a position error of the image formed on the transfer medium by each of the developing units 11, based on the result of the reading.

Operation of the image forming apparatus 200 in the second embodiment will be explained below. When only the first cover 71 is opened for replacing the black developer cartridge 12K, removing a sheet jam in the medium conveying unit 30, or the like, the control unit 230 detects that only the first cover 71 is opened, by the first cover sensor switch 211 and the second cover sensor switch 212. In this case, the control unit 230 judges that the cover has been opened but there is no change in positions of the developing units 11 or the exposure heads 16 relative to the main body 1, relating to a color registration error or a printing position error, and the control unit 230 does not perform a color registration error correction or a printing position error correction.

Meanwhile, when the second cover 72 is opened for replacing the Y, M, or C-color developer cartridge 12Y, 12M, or 12C, replacing the developing unit 11, replacing the fixing unit 54, replacing the transfer belt unit 41, removing a sheet jam in the fixing unit 54 or the transfer belt unit 41, or the like, the control unit 230 detects that the second cover 72 is opened by the second cover sensor switch 212. In this case, the control unit 230 judges that there is possibility that the developing units 11 or the exposure heads 16 have changed in position due to the opening of the cover, and after detecting that the second cover 72 is closed by the second cover sensor switch 212, performs a color registration error correction or a printing position error correction. Specifically, the control unit 230 rotates the transfer belt 42, forms check patterns of the respective colors (developer images) on the transfer belt 42 by using the developing units 11 corresponding to the respective colors, reads the check patterns of the respective colors on the transfer belt 42 by using the sensor unit 220 to detect a color registration error amount or a position error amount, and corrects a light emission position or light emission timing of the exposure heads 16 based on the detected color registration error amount or position error amount.

According to the second embodiment described above, the following advantageous effects (7) to (9) can be obtained, in addition to the advantageous effects (1) to (6) described above.

(7) According to the present embodiment, the image forming apparatus includes the control unit for correcting a position error of an image formed by each of the plurality of developing units when the control unit detects that the second cover is closed. According to this embodiment, even if the developing units or the exposure heads are changed in position due to opening or closing of the second cover, an image can be formed in an appropriate position.

(8) The control unit does not perform a position error correction when the first cover is closed. With this configuration, the number of times (or frequency) of the position error correction can be reduced, and, for example, a resource such as a time for position error correction can be reduced.

(9) According to one aspect, when the control unit detects that the second cover is closed, the control unit forms the pattern for correction on the transfer medium by each of the plurality of developing units, reads the formed patterns, and corrects the position error based on the result of the reading. According to this aspect, by reducing the number of times (or frequency) of position error correction, developer consumption due to position error correction can be reduced.

Specifically, in the case where an image forming apparatus includes four developing units to which four developer cartridges are detachably attached and a cover covering all of the four developer cartridges, and performs position error correction when the cover is closed, when any of the developer cartridges has been replaced, the position error correction is performed each time the cover is opened and closed, and the number of times (or frequency) of the position error correction is high. By contrast, in the present embodiment, the specified developer cartridge can be replaced by opening and closing only the first cover while maintaining the second cover in the closed state, and position error correction accompanying replacement of the specified developer cartridge can be eliminated. Therefore, the number of times (or frequency) of position error correction accompanying replacement of the developer cartridge can be reduced in comparison with the image forming apparatus mentioned above. Moreover, a medium jam in the medium conveying unit can be removed by opening and closing only the first cover while maintaining the second cover in the closed state, and position error correction accompanying removal of a medium jam in the medium conveying unit can be eliminated. Therefore, the number of times (or frequency) of position error correction accompanying removal of a medium jam can be reduced.

Those skilled in the art will recognize that further variations are possible within the scope of the invention, which is defined in the appended claims.

For example, although the above embodiments illustrate a case where the specified developer cartridge is a black developer cartridge, the specified developer cartridge may be another developer cartridge. For example, if a developer agent of a color other than black is frequently used, a developer cartridge corresponding to the other color may be the specified developer cartridge.

Further, although the above embodiments illustrate a case where the exposure head is an LED head with an LED, an exposure head having another type of light emitting element may be used instead.

What is claimed is:

1. An image forming apparatus comprising:

a plurality of developing units disposed in parallel with each other, a developer cartridge being detachably attached to each of the plurality of developing units, each of the plurality of developing units forming a developer image with a developer agent in the developer cartridge;

a first cover covering at least one specified developer cartridge of a plurality of developer cartridges attached to the plurality of developing units, the first cover being openable to allow the at least one specified developer cartridge to be attached and detached; and a second cover covering at least one developer cartridge other than the at least one specified developer cartridge of the plurality of developer cartridges, the second cover being openable to allow the at least one developer cartridge other than the at least one specified developer cartridge to be attached and detached, the second cover including a holding unit for holding each of the plurality of developing units in the closed state of the second cover, the holding unit being a latent image forming unit held by the second cover, the latent image forming unit engaging with each of the plurality of developing units and forming a latent image to be developed by each of the plurality of developing units in the closed state of the second cover;

wherein the first cover includes an information display unit for displaying information;

wherein the first and second covers are configured to be opened in the order of the first cover and the second cover, and to be closed in the order of the second cover and the first cover.

2. The image forming apparatus according to claim 1, wherein each of the first and second covers uncovers an upper part of the image forming apparatus in the open state.

3. The image forming apparatus according to claim 2, wherein the first cover has an L-shaped cross section and uncovers the upper part and a side part of the image forming apparatus in the open state.

4. The image forming apparatus according to claim 1, wherein the first cover uncovers a medium conveying unit for conveying a recording medium for image formation in the open state.

5. The image forming apparatus according to claim 1, wherein the second cover has a medium discharge portion on which a recording medium after image formation is discharged.

6. The image forming apparatus according to claim 1, further comprising a control unit for correcting a position error of an image formed by each of the plurality of developing units, when detecting that the second cover is closed, wherein the control unit does not perform the correction of the position error when only the first cover of the first and second covers is opened and closed.

7. The image forming apparatus according to claim 6, wherein the control unit, when detecting that the second cover is closed, forms a pattern for correction on a transfer medium by each of the plurality of developing units, reads the formed patterns, and corrects the position error based on the result of the reading.

8. The image forming apparatus according to claim 1, wherein directions in which the plurality of developer cartridges are attached and detached are substantially the same.

9. The image forming apparatus according to claim 1, wherein when the first and second covers are opened, the whole of an upper part of the plurality of developing units is uncovered.

10. An image forming apparatus comprising:

a plurality of developing units disposed in parallel with each other, a developer cartridge being detachably attached to each of the plurality of developing units, each of the plurality of developing units forming a developer image with a developer agent in the developer cartridge;

a first cover covering at least one specified developer cartridge of a plurality of developer cartridges attached to the plurality of developing units, the first cover being openable to allow the at least one specified developer cartridge to be attached and detached; and a second cover covering at least one developer cartridge other than the at least one specified developer cartridge of the plurality of developer cartridges, the second cover being openable to allow the at least one developer cartridge other than the at least one specified developer cartridge to be attached and detached, wherein each of the first and second covers uncovers an upper part of the image forming apparatus in the open state;

the first cover has an L-shaped cross section and uncovers the upper part and a side part of the image forming apparatus in the open state; and the first cover uncovers a medium conveying unit for conveying a recording medium for image formation in the open state.

11. The image forming apparatus according to claim 10, wherein directions in which the plurality of developer cartridges are attached and detached are substantially the same.

12. An image forming apparatus comprising:

a plurality of developing units disposed in parallel with each other, a developer cartridge being detachably attached to each of the plurality of developing units, each of the plurality of developing units forming a developer image with a developer agent in the developer cartridge;

a first cover covering at least one specified developer cartridge of a plurality of developer cartridges attached to the plurality of developing units, the first cover being openable to allow the at least one specified developer cartridge to be attached and detached;

a second cover covering at least one developer cartridge other than the at least one specified developer cartridge of the plurality of developer cartridges, the second cover being openable to allow the at least one developer cartridge other than the at least one specified developer cartridge to be attached and detached; and a control unit for correcting a position error of an image formed by each of the plurality of developing units, when detecting that the second cover is closed, wherein the control unit does not perform the correction of the position error when only the first cover of the first and second covers is opened and closed.

13. The image forming apparatus according to claim 12, wherein directions in which the plurality of developer cartridges are attached and detached are substantially the same.

* * * * *